US006991067B2

(12) United States Patent
Dube et al.

(10) Patent No.: US 6,991,067 B2
(45) Date of Patent: Jan. 31, 2006

(54) OBSTRUCTION SENSING SYSTEM UTILIZING PHYSICAL SHIELDING TO PREVENT ERRANT DETECTION

(75) Inventors: Claude R. Dube, Waynesboro, PA (US); Brandon F. Tucker, Harrisonville, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 144 days.

(21) Appl. No.: 10/221,220

(22) PCT Filed: Mar. 13, 2001

(86) PCT No.: PCT/US01/07774

§ 371 (c)(1),
(2), (4) Date: Oct. 24, 2002

(87) PCT Pub. No.: WO01/68507

PCT Pub. Date: Sep. 20, 2001

(65) Prior Publication Data

US 2003/0221916 A1 Dec. 4, 2003

Related U.S. Application Data

(60) Provisional application No. 60/188,616, filed on Mar. 13, 2000.

(51) Int. Cl.
*B66F 9/20* (2006.01)

(52) U.S. Cl. ..... 187/223; 187/300

(58) Field of Classification Search ..... 187/277, 187/223, 300, 313, 314, 316, 317, 391, 393; 340/505, 506, 518, 522, 565, 541; 318/280, 318/286, 466–490; 108/147
See application file for complete search history.

(56) References Cited

U.S. PATENT DOCUMENTS

| | | | | | |
|---|---|---|---|---|---|
| 4,392,771 | A | * | 7/1983 | Smalley | 414/545 |
| 4,556,129 | A | * | 12/1985 | Martin | 187/279 |
| 4,598,797 | A | * | 7/1986 | Schultz | 187/223 |
| 4,644,329 | A | * | 2/1987 | Brueske | 340/556 |
| 4,679,645 | A | | 7/1987 | Galloway et al. | |
| 4,724,554 | A | * | 2/1988 | Kowalski et al. | 5/610 |
| 4,768,713 | A | * | 9/1988 | Roper | 236/77 |
| 4,849,731 | A | | 7/1989 | Melocik | |
| 4,910,464 | A | | 3/1990 | Trett et al. | |
| 5,379,655 | A | * | 1/1995 | Yeakle | 73/865.7 |

(Continued)

FOREIGN PATENT DOCUMENTS

| | | | |
|---|---|---|---|
| DE | 2732611 | A | 2/1979 |
| JP | 08113440 | A * | 5/1996 |

*Primary Examiner*—Jonathan Salata
(74) *Attorney, Agent, or Firm*—Nixon & Vanderhye P.C.

(57) ABSTRACT

An obstruction sensing system is provided for a lift vehicle (10) with a lift platform (20). The system includes a plurality of sensors (32) mounted to the lift platform (20) and a control system (18) coupled with a drive system of the lift vehicle. The sensors collectively detect a profile of an area on a sensor side of the platform, and the control system generates a signal according to the profile detected by the plurality of sensors. The profile detected by the sensors may be compared with a stored plurality of area profiles by the control system based on a position of the lift platform or profiles of substantially symmetrical areas may be compared. If an obstruction is sensed during platform descent, further descent is halted and an alarm is sounded. The system also includes structure for overriding the disabling function.

24 Claims, 3 Drawing Sheets

U.S. PATENT DOCUMENTS 5,698,824 A * 12/1997 Platt ..... 187/317
6,050,369 A * 4/2000 Leone et al. ..... 187/392
6,169,379 B1 * 1/2001 Zhang et al. ..... 318/280
6,173,233 B1 1/2001 Janutka et al.
6,182,798 B1 * 2/2001 Brady et al. ..... 187/282
6,202,797 B1 * 3/2001 Skolnick et al. ..... 187/317
6,542,071 B1 * 4/2003 Ohtsubo et al. ..... 340/426.28
6,615,953 B1 * 9/2003 Steinweg ..... 187/393
6,617,845 B1 * 9/2003 Shafiyan-Rad et al. 324/207.16
2001/0013307 A1 * 8/2001 Stone ..... 108/147

* cited by examiner

OBSTRUCTION SENSING SYSTEM UTILIZING PHYSICAL SHIELDING TO PREVENT ERRANT DETECTION

This application is the U.S. national phase of International PCT Application No. PCT/US01/07774, filed Mar. 13, 2001, which designated the United States. PCT/US01/07774 claims the benefit of U.S. Provisional Patent Application Ser. No. 60/188,616, filed Mar. 13, 2000, the entire contents of which are herein incorporated by reference.

BACKGROUND OF THE INVENTION

The invention relates generally to obstruction sensing systems and, more particularly, to an obstruction sensing system that effects detection beneath the entire area of a platform and includes override functionality.

There are many uses for vertical lift products, including in large retail establishments, where inventory may be stored on high shelves and the like, and the vertical lift products are thus in use near customers. As such, it may be desirable to ensure that the area beneath the lift platform is clear from obstructions before lowering the platform. It is also advantageous to ensure that the area is clear from boxes, products, etc., to prevent damage to both the obstruction and the lift platform.

SUMMARY OF THE INVENTION

According to the present invention, an obstruction sensing system for a vertical lift product or stock picker incorporates sensors such as ultrasonic transducers or the like to detect an obstruction under any portion of the platform. The system is only active during platform descent, and the lift horn is sounded in a distinct pattern to signal the operator in the event of an obstruction. The system prevents the operator from further lowering the platform once an obstruction has been detected, and to acknowledge that an obstruction has been detected, the operator is required to sound the lift's horn momentarily using the platform button, raise the platform slightly, or recycle the main power system to re-enable lift functionality. Override capability is also provided, requiring the operator to hold the horn button and operate the lift down control implement at the same time.

In an exemplary embodiment of the invention, an obstruction sensing system for a lift vehicle including a lift platform has a plurality of sensors mountable to the lift platform and a control system coupleable with a drive system of the lift vehicle. The sensors collectively detect a profile of an area on a sensor side of the platform, and the control system generates a signal according to the profile detected by the sensors. The sensing system may include physical shielding cooperating with the plurality of sensors that prevents errant detection of objects that are not in the detected area. The control system may include a memory storing a plurality of area profiles based on a position of the lift platform. The control system compares the profile detected by the sensors with at least one of the stored plurality of area profiles according to a position of the lift platform. Alternatively, the sensors may detect the profile of separate substantially symmetrical areas, and the control system compares the first and second area profiles. Preferably, the sensors are ultrasonic transducers. In one exemplary arrangement, the plurality of sensors are mountable to an underside of the lift platform, wherein the area profile is a profile of a base of the lift vehicle and the ground.

In another exemplary embodiment of the invention, a lift vehicle includes a chassis supporting a lift platform, a driving system coupled with the lift platform for driving a lift platform, and the obstruction sensing system according to the invention. If the control system detects an obstruction according to the profile comparison during a lift down function by the driving mechanism, the control system generates a signal to halt further lowering of the lift platform. The vehicle may additionally include a horn operatively coupled with the control system, wherein the signal generated by the control system to halt further lowering of the lift platform additionally activates the horn. More generally, the control system includes structure for disabling the driving system when the control system detects an obstruction according to the profile detected by the sensors. The system is preferably also provided with structure for overriding the disabling structure, which may include the vehicle horn and a control implement that activates the driving system. In this context, the disabling function is effected when the horn and the control implement are activated simultaneously.

In still another exemplary embodiment of the invention, a method of sensing obstructions in the traveling path of a lift vehicle lift platform includes (a) detecting a profile of an area on a traveling path side of the lift platform, and (b) generating a signal according to the profile detected in step (a).

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
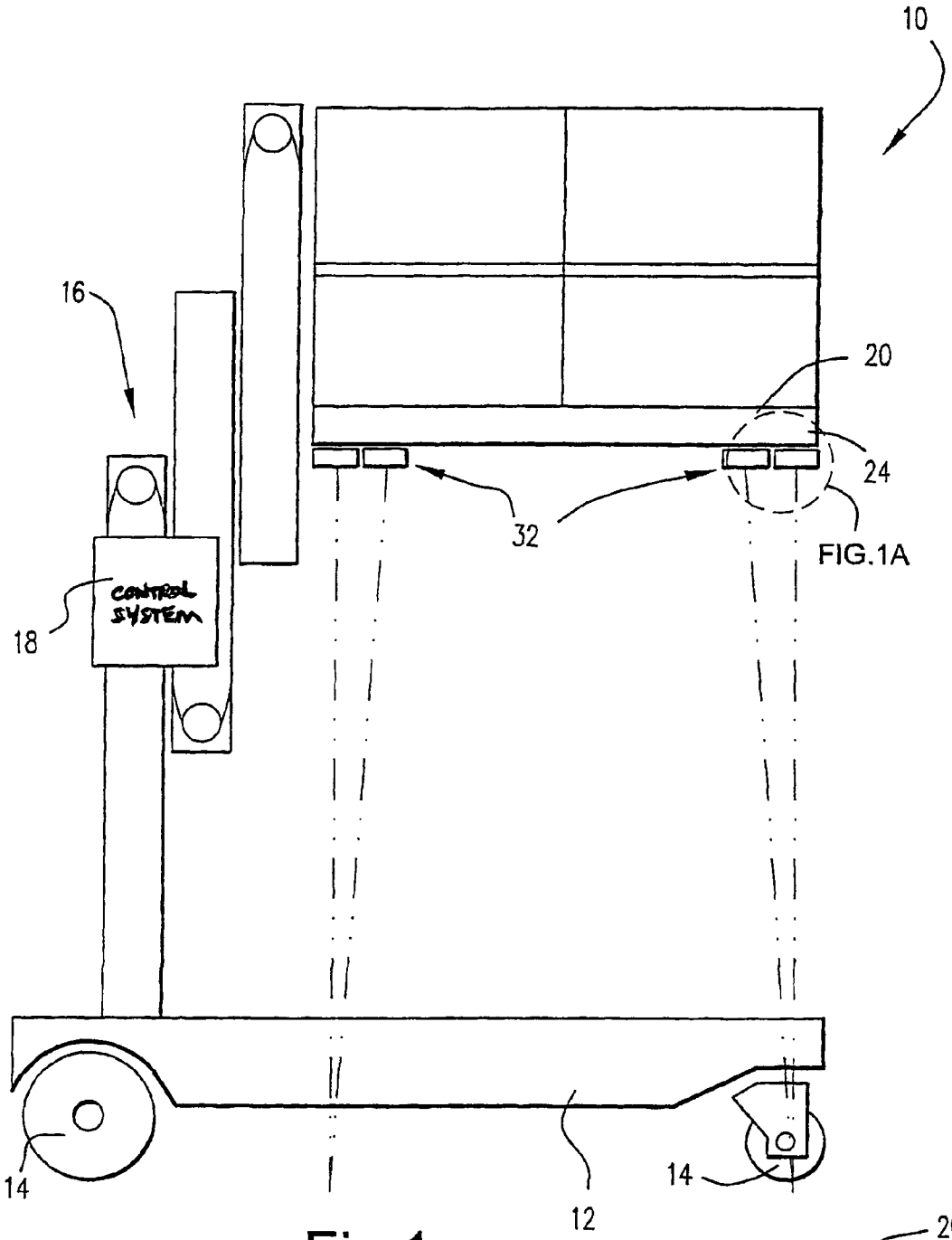
FIG. 1 is a side view of a stock picker in a raised position with the obstruction sensing system according to the invention.

As shown in FIG. 1, a stock picker 10 typically includes a chassis or base 12 mounted on wheels 14, a boom or lift assembly 16, power and control units 18 mounted to the boom or lift assembly, and a vertically movable platform 20, which also likely has lift controls. The obstruction sensing system according to the invention comprises a microprocessor 30 (FIG. 2) communicating with a plurality of sensors such as ultrasonic transducers. The transducers 32 are mounted to the underside of the platform 20 to sense the entire area beneath the platform, while preventing sensing more than three inches (3") beyond the area beneath the platform.

The system preferably contains a series of transducer pairs mounted underneath the platform floor. One of the transducers in each pair sends out an ultrasonic signal, and the other of the pair listens for a reflection as shown schematically in FIG. 1. The transducers 32 may be attached to the platform in any suitable manner.

Figure 1A:
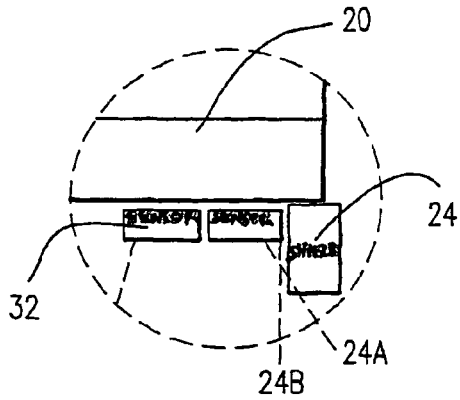
FIG. 1A is a close-up view of the sensor shielding.

The sensing area is limited by physical shielding 24 and software intelligence to prevent errant detection of objects that are not directly under the platform. As shown in FIG. 1A, the physical shielding 24 limits a sensing area of the sensors, showing a potential path 24A of the sensing signal and a shielded path 24B. The sensors 32 are thus configured to sense substantially all of the area on the sensor side of the platform. The system is programmed to check for obstructions within a preset distance from the platform 20. When the platform 20 is within this distance from the base 12 of the machine, the microprocessor 30 is programmed to recognize the profile (signature) of the machine and floor beneath the platform 20 and determines whether an obstruction is present by comparing the profile that it expects to see with the detected profile. The profiles are preferably preprogrammed for the port and starboard sides, as well as fore and aft sides, which profiles further differ depending on the height of the platform. The system recognizes the base 12 of the machine in relation to the ground. Any differences from the expected profile will cause the lift down function to be stopped.

In an alternative arrangement, the sensors 32 are connected to both a receiving multiplexer and a transmit multiplexer. During operation, the microprocessor 30 causes the transmitting transducers in the sensors to transmit ultrasonic pulses that travel through the air beneath the lift platform 20. The ultrasonic waves reflect from objects in their path, and the resulting echoes return to receiving transducers in the sensors 32, which convert the acoustic echoes into electrical signals that represent the machine profiles. The received echo signals are then amplified and detected by the system. The microprocessor 30 uses a processing algorithm based on a comparison of the symmetry of the echoes from one side of the lift platform to the other to determine if an obstacle is present under the platform. If the echoes are symmetric, no obstacle is present beneath the lift. If the echoes are not symmetric, an obstacle is present.

In addition to doing profile comparisons to determine if an obstruction is present, the system is also monitoring the profiles via the return echoes to determine if the echoes are returning too quickly. If the echoes are returning too quickly and the system does not see a preprogrammed profile, the system will stop the platform 20 regardless of symmetry or profile comparison.

For example, presume the system is programmed to trigger if an obstruction is detected 20" (about 51 cm) or less from the platform. (This value is programmable.) If the system sees any obstructions within 20" (about 51 cm) of the platform (regardless of symmetry or which transducer detects it) and it does not detect a profile that it has been programmed to ignore, it will stop the platform. If the platform is elevated to 10' (about 3 m) and an attempt is made to lower the platform over a flat shelf, which is symmetrical in reference to the sensor system, once within 20" (about 51 cm) of the shelf, the system will think there is a problem. It will then determine whether what it sees matches any of the preprogrammed profiles. If not, it will stop the platform. It would also perform this way if the obstruction were not symmetrical.

Any suitable sensors 32 can be incorporated into the obstruction sensing system of the invention, and the invention is not meant to be limited to a particular transducer. An example of a suitable transducer is available from MASSA Products Corporation of Hingham, Mass. Of course, the invention may also be used with sensors other than ultrasonic transducers, provided they are suitable for the described purpose.

Figure 2:
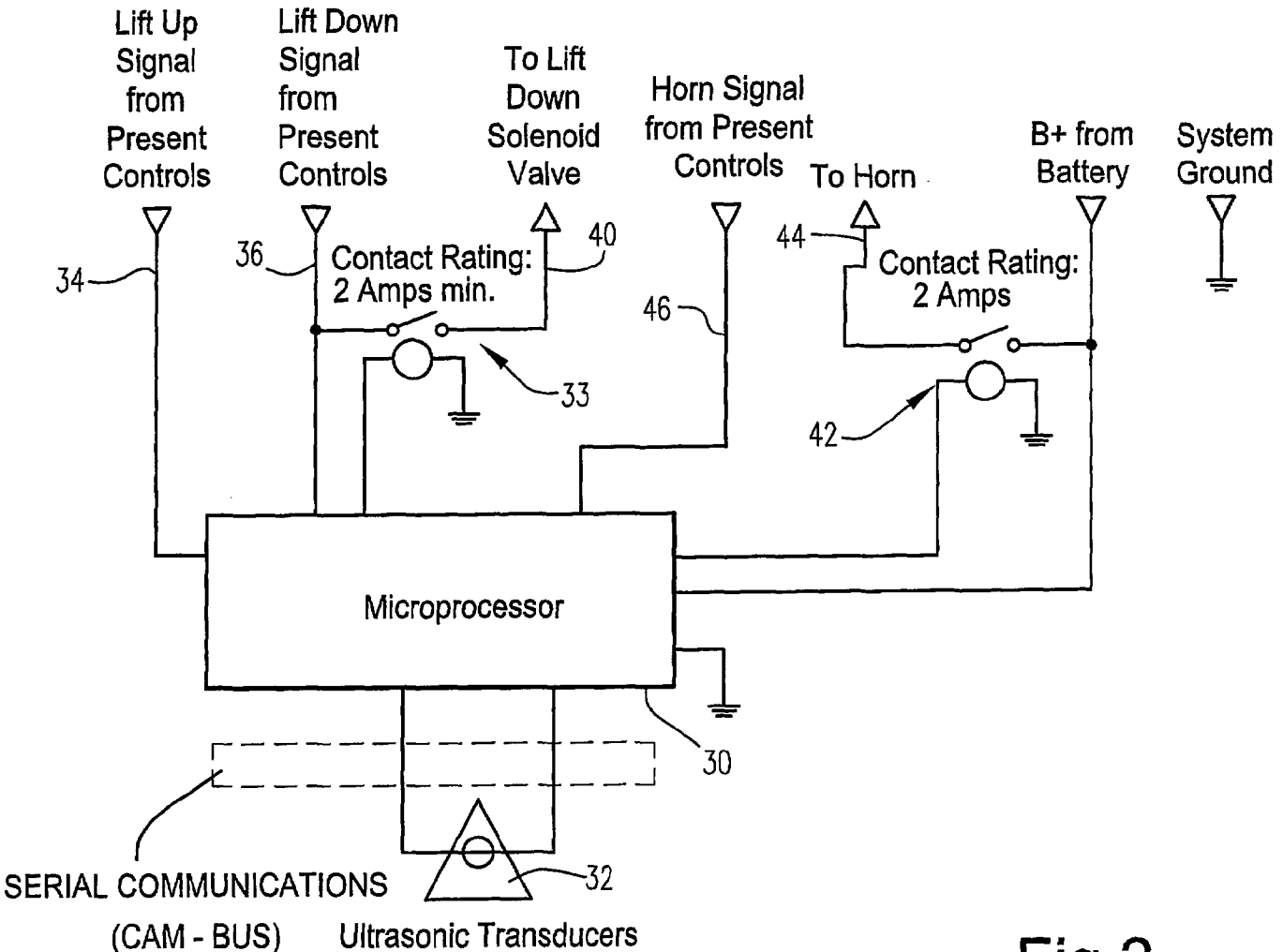
FIG. 2 is a schematic circuit diagram for the obstruction sensing system.

FIG. 2 is a schematic circuit diagram for the obstruction sensing system according to the invention. A microprocessor 30 controls the operation of the system based on signals from the ultrasonic transducers 32 mounted to the platform 20. In a preferred embodiment, the system is only active during platform descent, and the lift up signal via 34 from the control panel is received by the microprocessor 30, which activates the components to effect platform lift. When an operator moves the controls to initiate a lift down signal via 36, the microprocessor 30 polls the ultrasonic transducers 32 to determine if there is an obstruction beneath the platform.

If there is no obstruction, the microprocessor 30 activates the lift down function via a lift down switch 38, and an activate signal via 40 is sent to the vehicle components that effect lowering of the platform, such as a lift down solenoid or the like. If the ultrasonic transducers 32 detect an obstruction before or during the lift down function, the microprocessor 30 prevents further lowering of the platform by switch 38, and the microprocessor 30 activates the horn via a horn switch 42 to send a signal via 44 to sound the vehicle horn. Preferably, the horn is sounded in a distinct pattern to alert the operator of the obstruction. Additionally, a warning light may be caused to illuminate or flash. In order to re-enable lift down functionality, the system is programmed to require the operator to sound the horn from the control panel, which sends an acknowledgment signal via 46 to the microprocessor 30, activate the lift up function of the control system to slightly raise the platform 20, or recycle the main power system. When the operator again moves the controls to lower the platform 20, the process is repeated with the microprocessor 30 polling the ultrasonic transducers 32.

The obstruction sensing system according to the invention also enables the system to be overridden, if necessary. The system is programmed to allow the lift to be lowered when the operator holds the vehicle horn button and a vehicle control implement such as the lift down controls at the same time. That is, when a lift down signal is received by the microprocessor 30 via 36, the microprocessor will enable the lift down switch 38 when there is no obstructions sensed by the ultrasonic transducers 32 or when the microprocessor 30 is receiving a signal from the vehicle horn via 46.

As discussed above, if the ultrasonic transducers 32 detect an obstruction before or during the lift down function, the microprocessor 30 prevents further lowering of the platform by switch 38. Thus, during the lift down function, the microprocessor 30 is continuously polling the ultrasonic transducers 32, and further lowering is quickly halted upon the detection of an obstruction.

Figure 3:
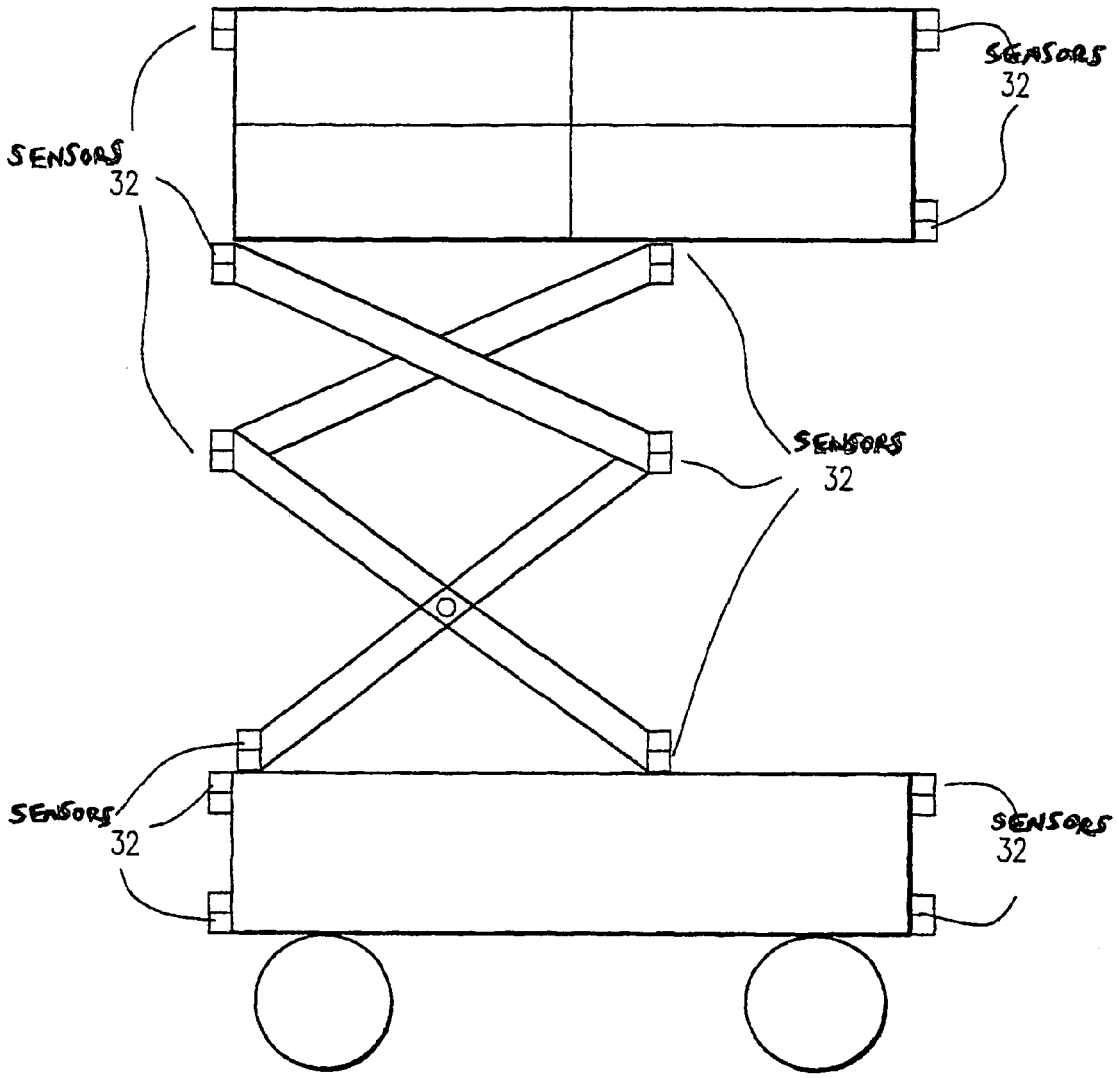
FIG. 3 shows an exemplary alternative application of the obstruction sensing system.

The obstruction sensing system according to the present invention effects safe operation of a lift vehicle lift platform by detecting obstructions in the traveling path of the lift platform during platform descent. Upon detection of an obstruction, further descent of the platform is prevented, thereby protecting the vehicle as well as the obstruction itself. Of course, as shown in FIG. 3, the obstruction sensing system according to the invention may apply to various types of industrial machinery and not just the exemplary vertical lift product shown in FIG. 1. For example, the system may apply to other aerial lifts working in a sensitive environment where the items sensed are at some predetermined horizontal distance from the encroaching surface of the machine (e.g., aircraft assembling machine or other such apparatus, etc.). The system may also be used on all surfaces of a fully enclosed moving structure where contact may occur with other sensitive surfaces (e.g., aircraft de-icing machines, underground rock mining machines, etc.).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An obstruction sensing system for a lift vehicle including a lift platform, the obstruction sensing system comprising:

a plurality of sensors mountable to the lift platform, the sensors collectively detecting a profile of an area on a sensor side of the platform;

physical shielding cooperating with the plurality of sensors that prevents errant detection of objects that are not in the detected area; and a control system coupleable with a drive system of the lift vehicle, the control system generating a signal according to the profile detected by the plurality of sensors.

2. An obstruction sensing system according to claim 1, wherein the control system comprises a memory storing a plurality of area profiles based on a position of the lift platform, the control system comparing the profile detected by the plurality of sensors with at least one of the stored plurality of area profiles according to a position of the lift platform.

3. An obstruction sensing system according to claim 1, wherein the control system comprises:

means for distinguishing the profile of a first area and the profile of a second area substantially symmetrical relative to the first area; and means for comparing the first area profile and the second area profile.

4. An obstruction sensing system according to claim 1, wherein the plurality of sensors are ultrasonic transducers.

5. An obstruction sensing system according to claim 1, wherein the plurality of sensors are mountable to an underside of the lift platform, and wherein the area profile is a profile of a base of the lift vehicle and the ground.

6. A lift vehicle comprising:

a chassis supporting a lift platform;

a driving system coupled with the lift platform for driving the lift platform; and an obstruction sensing system, including:

a plurality of sensors mounted to the lift platform, the sensors collectively detecting a profile of an area on a sensor side of the platform, physical shielding cooperating with the plurality of sensors that prevents errant detection of objects that are not in the detected area; and a control system coupled with the driving system of the lift vehicle, the control system generating a signal according to the profile detected by the plurality of sensors.

7. A lift vehicle according to claim 6, wherein the control system comprises a memory storing a plurality of area profiles based on a position of the lift platform, the control system comparing the profile detected by the plurality of sensors with at least one of the stored plurality of area profiles according to a position of the lift platform.

8. A lift vehicle according to claim 7, wherein if the control system detects an obstruction according to the profile comparison during a lift down function by the driving mechanism, the control system generates a signal to halt further lowering of the lift platform.

9. A lift vehicle according to claim 8, further comprising a horn operatively coupled with the control system, wherein the signal generated by the control system to halt further lowering of the lift platform additionally activates the horn.

10. A lift vehicle according to claim 6, wherein the control system comprises:

means for distinguishing the profile of a first area and the profile of a second area substantially symmetrical relative to the first area; and means for comparing the first area profile and the second area profile.

11. A lift vehicle according to claim 6, wherein the control system comprises means for disabling the driving system when the control system detects an obstruction according to the profile detected by the sensors.

12. A lift vehicle according to claim 11, further comprising a horn operatively coupled with the control system, wherein the control system further comprises means for activating the horn when the control system detects an obstruction.

13. A lift vehicle according to claim 11, further comprising means for overriding the disabling means.

14. A lift vehicle according to claim 13, wherein the overriding means comprises a horn operatively coupled with the control system and a control implement that activates the driving system, wherein a disabling function is effected when the horn and the control implement are activated simultaneously.

15. A lift vehicle according to claim 6, wherein the sensors are configured to sense substantially all of the area on the sensor side of the platform.

16. A method of sensing obstructions in the traveling path of a lift vehicle lift platform, the method comprising:

(a) detecting a profile of an area on a traveling path side of the lift platform; and (b) generating a signal according to the profile detected in step (a), wherein step (a) is practiced by preventing errant detection of objects that are not in the detected area.

17. A method according to claim 16, further comprising, prior to step (a), storing a plurality of area profiles based on a position of the lift platform, wherein step (b) is practiced by comparing the profile detected in step (a) with at least one of the stored plurality of area profiles according to a position of the lift platform.

18. A method according to claim 17, wherein if an obstruction is detected according to the profile comparison during a lift down function of the lift platform, step (b) is practiced by generating a signal to halt further lowering of the lift platform.

19. A method according to claim 18, wherein step (b) is further practiced by activating a vehicle horn.

20. A method according to claim 18, further comprising disabling the lift platform when an obstruction is detected according to the profile detected in step (a).

21. A method according to claim 20, further comprising activating a vehicle horn when an obstruction is detected.

22. A method according to claim 20, further comprising selectively overriding the disabling step.

23. A method according to claim 22, wherein the overriding step comprises simultaneously activating a vehicle horn and a vehicle control implement.

24. A method according to claim 16, wherein step (a) is practiced by distinguishing the profile of a first area and the profile of a second area, and wherein step (b) is practiced by comparing the first area profile and the second area profile.

* * * * *